US008485000B2

(12) United States Patent
Lim et al.

(10) Patent No.: US 8,485,000 B2
(45) Date of Patent: Jul. 16, 2013

(54) CLOTHES TREATING APPARATUS WITH LIQUID RESERVOIR

(75) Inventors: Minkyu Lim, Gyeongsangnam-Do (KR); Myoungjong Kim, Gyeongsangnam-Do (KR); Deokjoon Jeong, Gyeongsangnam-Do (KR); Yeonsik Choi, Gyeongsangnam-Do (KR); Sunhwa Yu, Gyeongsangnam-Do (KR); Jaehong Kim, Gyeongsangnam-Do (KR); Bohyoung Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 440 days.

(21) Appl. No.: 12/845,596

(22) Filed: Jul. 28, 2010

(65) Prior Publication Data

US 2011/0023241 A1 Feb. 3, 2011

Related U.S. Application Data

(60) Provisional application No. 61/213,951, filed on Jul. 31, 2009, provisional application No. 61/213,953, filed on Jul. 31, 2009, provisional application No. 61/213,954, filed on Jul. 31, 2009, provisional application No. 61/213,958, filed on Jul. 31, 2009.

(30) Foreign Application Priority Data

Jul. 31, 2009 (KR) ..... 10-2009-00070959
Jul. 31, 2009 (KR) ..... 10-2009-00070966
Jul. 31, 2009 (KR) ..... 10-2009-00070968
Jul. 31, 2009 (KR) ..... 10-2009-00070971

(51) Int. Cl.
*D06F 29/00* (2006.01)
*D06F 35/00* (2006.01)

(52) U.S. Cl.
USPC ..... 68/17 R; 68/3 R

(58) Field of Classification Search
USPC ..... 68/17 R
See application file for complete search history.

(56) References Cited

U.S. PATENT DOCUMENTS 5,836,180 A * 11/1998 Herman-Latack et al. ... 68/17 R
2003/0172690 A1 * 9/2003 Kim et al. ..... 68/17 R

FOREIGN PATENT DOCUMENTS

| | | | |
|---|---|---|---|
| CN | 101805981 | | 8/2010 |
| DE | 10-2009-042154 | A1 | 4/2010 |
| DE | 10-2009-042903 | A1 | 4/2010 |
| KR | 10-2010-0075325 | A | 7/2010 |
| KR | 10-2010-0088985 | A | 8/2010 |
| KR | 10-2011-0013012 | A | 2/2011 |
| KR | 10-2011-0013014 | A | 2/2011 |

* cited by examiner

*Primary Examiner* — Michael Barr
*Assistant Examiner* — Jason Ko
(74) *Attorney, Agent, or Firm* — McKenna Long & Aldridge LLP

(57) ABSTRACT

A clothes treating apparatus having a liquid reservoir comprises a body having a drum therein, a liquid spraying means configured to spray liquid into the drum, a reservoir installation portion disposed at an inner upper portion of the body, a coupling means slidably installed in the reservoir installation portion, and a liquid reservoir detachably fixed into the coupling means and having an outlet on a side surface thereof, wherein a cut-out portion communicated with the reservoir installation portion and through which the liquid reservoir passes is formed on an upper surface of the body, and the liquid reservoir is connected to the liquid spraying means by sliding movement of the coupling means.

19 Claims, 9 Drawing Sheets

CLOTHES TREATING APPARATUS WITH LIQUID RESERVOIR

CROSS-REFERENCE TO A RELATED APPLICATION

Pursuant to 35 U.S.C. §119(a), this application claims the benefit of earlier filing date and right of priority to Korean Application 10-2009-0070959, 10-2009-0070966, 10-2009-0070968 and 10-2009-0070971 filed on Jul. 31, 2009, and U.S. Patent Application No. 61/213,951, 61/213,953, 61/213,954 and 61/213,958 filed on Jul. 31, 2009, the content of which is incorporated by reference herein in its entirety.

BACKGROUND OF THE INVENTION

1. Field of the Invention

The present invention relates to a clothes treating apparatus with a liquid reservoir, and particularly, to a clothes treating apparatus having a liquid reservoir for storing therein liquid to be sprayed to clothes, an object to be processed during a clothes treating process.

2. Background of the Invention

Generally, a clothes treating apparatus such as a washing machine and a clothes dryer serves to remove stains or spots and moisture from clothes. For this, clothes are firstly introduced into a drum rotatably installed in a body. The stains or spots of the clothes are removed by friction energy with water, and collision energy, etc., and the moisture thereof is removed by supplied hot blast.

In the clothes treating processes, fragrant liquid may be sprayed into the dram during a drying process so as to provide specific fragrant material to clothes having been completely dried. Furthermore, water or steam may be sprayed into clothes so as to prevent the clothes from being too stiff due to excessive drying, or so as to prevent the occurrence of static electricity.

The clothes treating apparatus includes a liquid reservoir configured to store therein fragrant liquid or water to be sprayed to clothes, a spray means such as a pump and a nozzle configured to spray the liquid stored in the liquid reservoir, a valve configured to connect the pump and the liquid reservoir with each other, etc. The liquid reservoir may be disposed at an arbitrary position of the clothes treating apparatus. However, the liquid reservoir is preferably disposed at an upper side of a body with consideration of efficient space utilization inside the clothes treating apparatus and a user's convenience.

In order to supplement liquid into the liquid reservoir, a user has to be easily accessible to the liquid reservoir. Here, the liquid should not leak or should not be separated from the pump during a clothes treating process. To this end, a drawer type method for mounting a liquid reservoir has been proposed.

According to the drawer type method, a liquid reservoir mounting portion that can be withdrawn to the outside is installed on a front surface of a clothes treating apparatus. Once a user pulls a part of a front panel, i.e., a drawer cover, a drawer coupled to a rear surface of the drawer cover is withdrawn to the outside along a rail. In this state, a liquid reservoir may be mounted in the drawer, or a liquid reservoir mounted in the drawer may be taken out of the drawer.

According to the drawer type method, a pump and a liquid reservoir can be connected to each other as the drawer is simply pushed. This may enhance a user's convenience. However, in order to prevent a connection port between the pump and the liquid reservoir from becoming loose while the drawer is being used, the drawer has to be mounted in the body so as to have a proper frictional force. This may cause the user to have a difficulty in withdrawing the drawer. Furthermore, in order to take the liquid reservoir out of the drawer, the drawer has to be withdrawn with a length longer than that of the liquid reservoir. For smooth withdrawing, an additional rail has to be installed for prevention of frictions or eccentric movements that may occur during a withdrawing process.

Furthermore, since a part of the front panel serves as a drawer cover, design degrees of freedom of the front panel may be degraded. This may be a serious problem when considering a recent trend to prefer a product having a better design to a product having a better function, and the fact that a type of the front panel greatly influences on the entire design of the clothes treating apparatus.

SUMMARY OF THE INVENTION

Therefore, an object of the present invention is to provide a clothes treating apparatus having a coupling structure capable of easily and stably mounting or detaching a liquid reservoir to/from a reservoir installation portion without having a limitation of a type of a front panel.

To achieve these and other advantages and in accordance with the purpose of the present invention, as embodied and broadly described herein, there is provided a clothes treating apparatus with a liquid reservoir, the apparatus comprising: a body having a drum therein; a liquid spraying means configured to spray liquid into the drum; a reservoir installation portion disposed at an inner upper portion of the body; a coupling means slidably installed in the reservoir installation portion; and a liquid reservoir detachably fixed into the coupling means, and having an outlet on a side surface thereof, wherein a cut-out portion communicated with the reservoir installation portion and through which the liquid reservoir passes is formed on an upper surface of the body, and the liquid reservoir is connected to the liquid spraying means by sliding movement of the coupling means.

In the present invention, the liquid reservoir may be introduced into the reservoir installation portion through the cut-out portion formed on an upper surface of the body, and then may be slid to be connected to the liquid spraying means. Here, the coupling means may be configured to stably support the liquid reservoir, and to guide the liquid reservoir so as to perform smooth sliding movement. Due to no components disposed at the front panel, the design degrees of freedom of the front panel may be enhanced. Furthermore, since an initial introduction position of the liquid reservoir may be near the liquid spraying means, a sliding distance of the liquid reservoir may be shortened. This may require no installation of a rail.

In some cases, may be considered an example to omit the coupling means, and to connect the liquid reservoir to the liquid spraying means by sliding only the liquid reservoir.

The coupling means may be provided with a cartridge mounted to inside thereof, and may be installed so as to be slidable in the reservoir installation portion.

The reservoir installation portion may include two side walls facing each other, and a bottom surface which connects lower portions of the side walls with each other. And, the reservoir installation portion may be formed so as to be extending in back and forth directions of the body. Here, the side walls and the bottom wall support side surfaces and a bottom surface of the liquid reservoir, respectively.

A connection portion connected to the outlet of the liquid spraying means may be installed at the reservoir installation portion.

Here, the connection portion may include a guide portion formed at an inner side thereof with a cylindrical shape and configured to insert the outlet thereinto, and a check valve installed in the guide portion.

The clothes treating apparatus may further comprise a guide means configured to guide the liquid reservoir so as to be installed at a precise position. The guide means may include a protrusion formed on a bottom surface of the liquid reservoir, and a concaved portion formed on a bottom surface of the coupling means and engaged with the protrusion.

The clothes treating apparatus may further comprise a cover positioned above the coupling means. In this case, a display means moved together with the coupling means may be disposed at the cover.

The display means may include an indicator disposed at an upper side of the cover, and a coupling portion disposed at a lower side of the cover and coupled to the coupling means. The indicator may be extending from the coupling means and upwardly protruding by penetrating through the cover.

The clothes treating apparatus may further comprise a door configured to open and close the cut-out portion.

A handgrip may be formed on one side surface of the liquid reservoir. The handgrip may facilitate separation of the liquid reservoir, and may be formed in any shape.

The handgrip may be protruding from a side surface of the liquid reservoir. Here, the handgrip may be positioned such that its bottom surface is spacing from a surface of the cover. A part of the cover positioned below the handgrip may form an inclination surface.

According to another aspect of the present invention, there is provided a clothes treating apparatus with a liquid reservoir, the apparatus comprising: a body having a drum therein; a liquid spraying means configured to spray liquid into the drum; a reservoir installation portion disposed at an inner upper portion of the body; a coupling means detachably mounted to the reservoir installation portion by being slid in the reservoir installation portion, and having an outlet on a side surface thereof; and a water level sensor installed in the reservoir installation portion, and configured to detect a level of liquid stored in the liquid reservoir by using changes of capacitance, wherein a cut-out portion communicated with the reservoir installation portion and through which the liquid reservoir passes is formed on an upper surface of the body, and the liquid reservoir is connected to the liquid spraying means by sliding movement of the coupling means.

When compared with a sensor for detecting a water level by directly contacting liquid, the capacitance type water level sensor may enhance reliability of a product by minimizing the occurrence of a mal-operation due to contaminations.

The water level sensor may include an electrode plate having dielectric polarization according to whether it approaches to liquid inside the liquid reservoir, and a housing configured to accommodate the electrode plate therein.

The housing may be installed at a rear side of the liquid reservoir such that a front surface of the housing faces a rear surface of the liquid reservoir.

A protrusion may be formed on the front surface of the housing facing the liquid reservoir, thereby preventing moisture from remaining between an outer surface of the liquid reservoir and the housing due to direct contact therebetween.

The housing may include a spring mounting portion backwardly protruding from a central portion of a rear surface of the housing, a spring inserted into an outer circumference of the spring mounting portion, and a coupling portion backwardly protruding from a rear surface of the housing and having a hook at an end thereof.

The water level sensor may further include a sensing unit configured to sense changes of capacitance according to dielectric polarization of the electrode plate, and to transmit a signal to a microcomputer.

When it is determined that fragrant liquid has a low level based on a received signal, the microcomputer may display the low level state on a display unit provided on a front surface of the body.

To achieve these and other advantages and in accordance with the purpose of the present invention, as embodied and broadly described herein, there is also provided a method for driving the clothes treating apparatus, the method comprising: detecting a water level by the water level sensor when a drying course including a liquid spraying process is selected; and performing the selected drying course, wherein the liquid spraying process is stopped if a low level is detected while performing the drying course.

Once a user selects the drying course including a liquid spraying process, the water level sensor detects a water level. If a low level is detected, the low level state may be displayed to the outside. In this case, the user may perform a desired drying course including a liquid spraying process by supplementing liquid and pressing a start button of the selected drying course. Alternatively, the user may perform a drying course without a liquid spraying process by pressing a start button of the selected drying course in a state that the low level state is displayed.

If a low level state is detected while performing the drying course, the selected drying course may be continuously performed whereas the liquid spraying process is stopped.

Alternatively, if a low level is detected while performing the drying course, the selected drying course may be continuously performed without displaying the low level state to the outside.

Still alternatively, the low level state may be displayed to the outside after completing the selected drying course. Here, the low level state may be displayed in a visual or auditory manner.

In the present invention, the cut-out portion through which the liquid reservoir is introduced may be formed on an upper surface of the body, and the front panel may have no components. This may enhance design degrees of freedom of the front panel. Furthermore, since an initial introduction position of the liquid reservoir may be near the liquid spraying means, a sliding distance of the liquid reservoir may be shortened. This may require no installation of a rail thereby reducing the fabrication costs.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Hereinafter, a clothes treating apparatus having a liquid reservoir according to the present invention will be explained in more detail with reference to the attached drawings.

Figure 1:
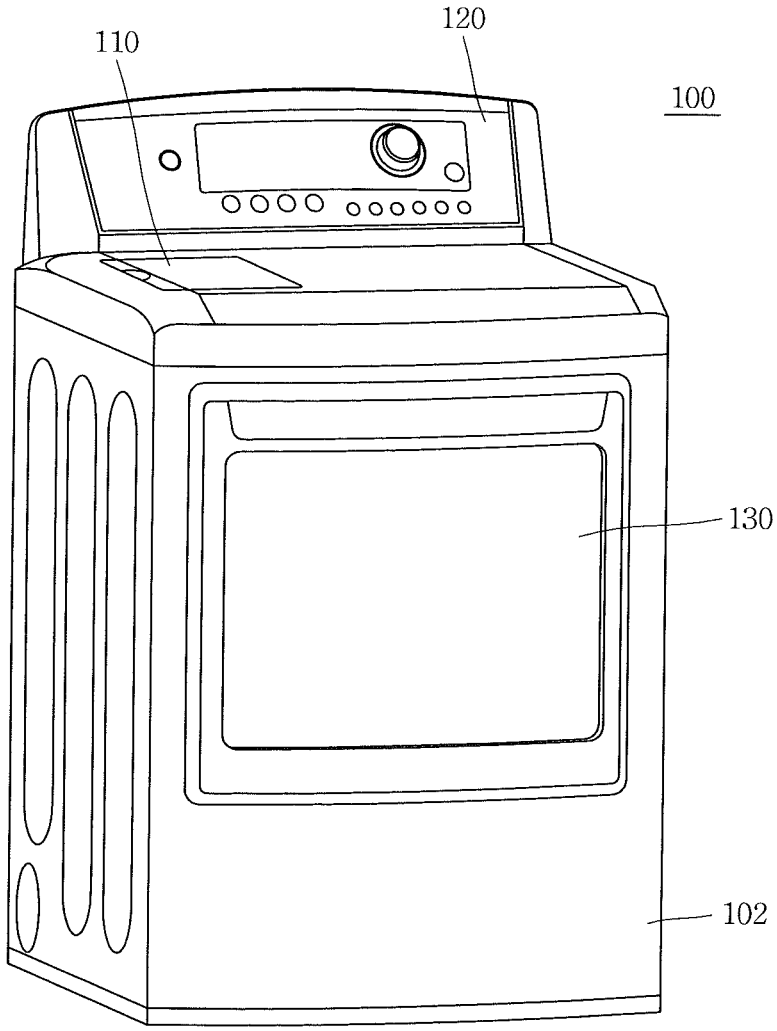
FIG. 1 is a perspective view of a clothes treating apparatus having a liquid reservoir according to one embodiment of the present invention.

FIG. 1 is a perspective view of a clothes treating apparatus having a liquid reservoir according to one embodiment of the present invention.

The present invention is not limited to a clothes treating apparatus, but may be applicable to any clothes treating apparatus such as a washing machine having an inner space and a door for opening and closing the inner space to which clothes have been introduced.

Referring to FIG. 1, the clothes treating apparatus 100 includes a body 102 which forms appearance, and a manipulation panel 120 configured to manipulate the clothes treating apparatus is disposed at an upper portion of the body 102. A door assembly 130 configured to open and close an opening (not shown) formed on a front surface of the body is coupled to the front surface of the body 102 by a hinge (not shown).

A cartridge (not shown) serving as a liquid reservoir is mounted to store therein liquid (water or fragrant liquid) to be sprayed into a drum through an upper surface of the body 102 during a drying process. A cut-out portion (not shown) through which the cartridge passes is formed on the upper surface of the body 102, and a door 110 covering the cut-out portion is installed on the upper surface of the body 102.

Figure 2:
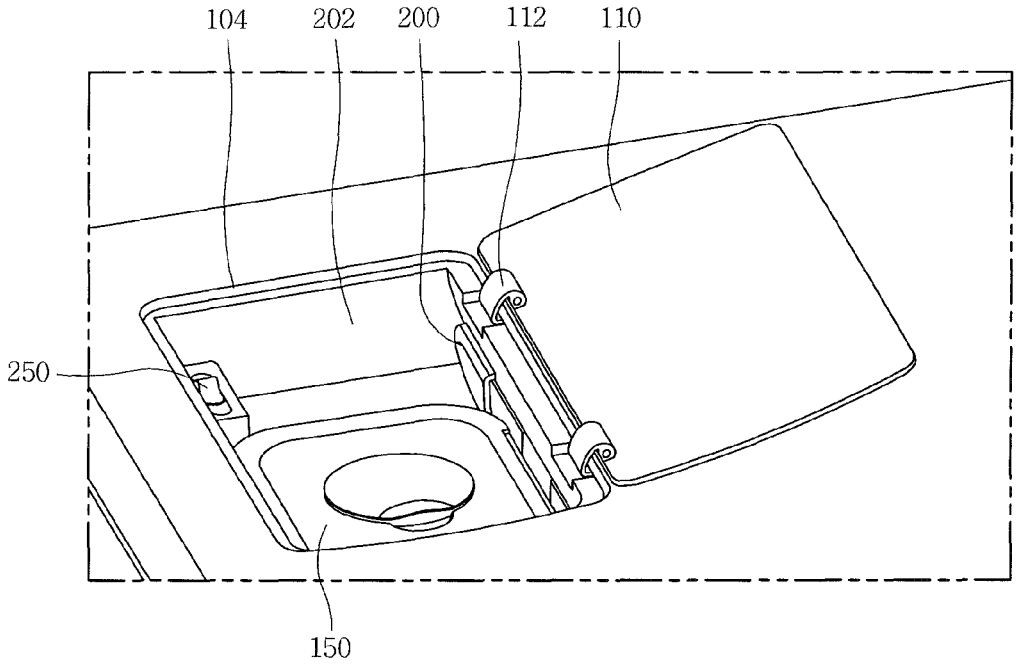
FIG. 2 is a perspective view showing a state that a door of FIG. 1 has been open.

FIG. 2 is a perspective view showing a state that the door 110 of FIG. 1 has been open. The door 110 is coupled to one side surface of a cut-out portion 104 having a rectangular shape and formed on the upper surface of the body 102 by two hinges 112. The hinges 112 are so-called a 'double hinge' type as hinge shafts are formed at both the door 110 and the body 102.

Figure 4:
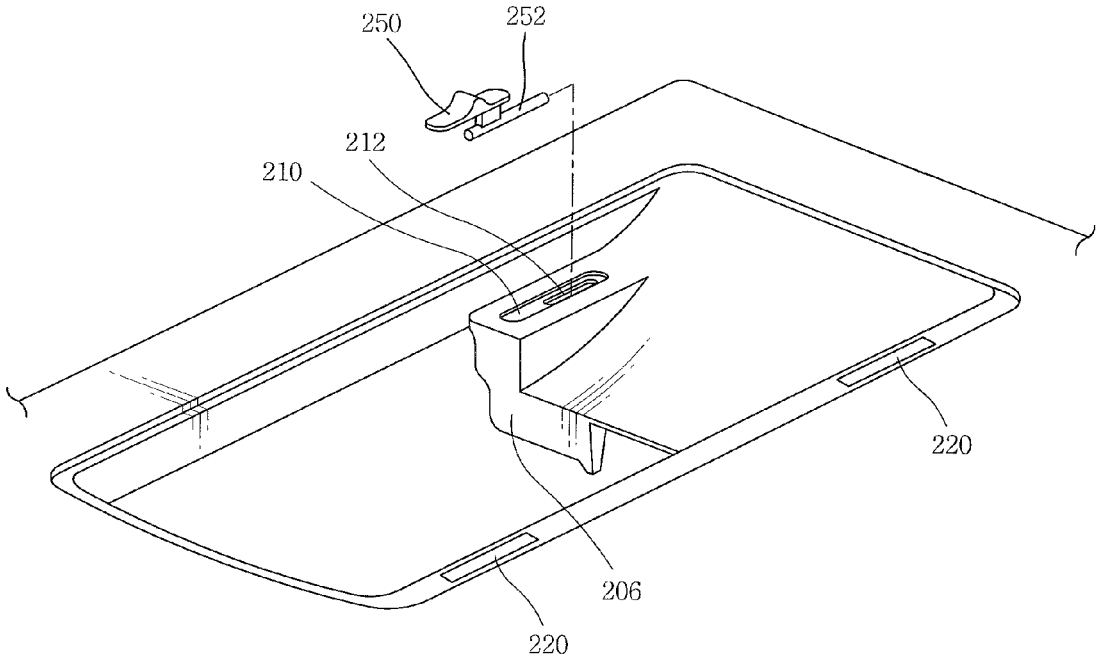
FIG. 4 is an enlarged perspective view of a cover of FIG. 1.

A cartridge 150 is mounted in the cut-out portion 104, and a cover 200 is mounted to an inner edge of the cut-out portion 104. The cover 200 shields components installed in the body by covering a part of the cut-out portion 104. As shown in FIG. 4, the cover 200 has one open side. The cover 200 will be explained later in more detail.

Figure 3:
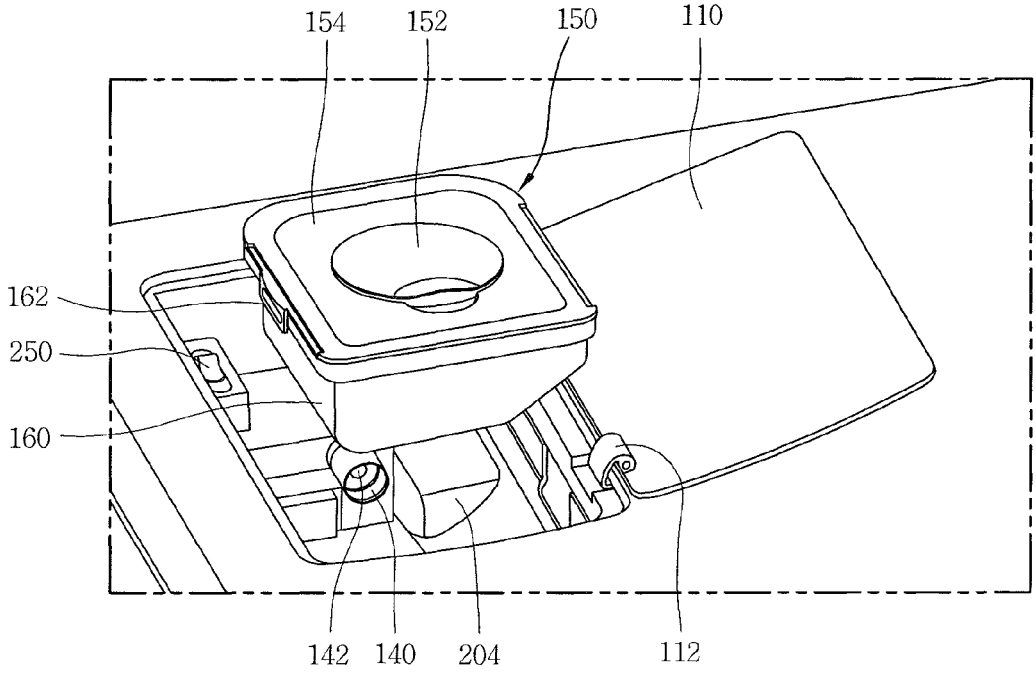
FIG. 3 is an exploded perspective view showing a state that a cartridge of FIG. 1 has been separated.

FIG. 3 is an exploded perspective view showing a state that the cartridge 150 of FIG. 1 has been separated. Referring to FIG. 3, the cartridge 150 includes a lid 154 and a container 160. Liquid is stored in the container 160, and the lid 154 opens and closes an upper surface of the container 160. The lid 154 is configured to be separated from the container 160. The lid 154 is coupled to the container 160 as fixing protrusions 162 formed at both side surfaces of the lid 154 are coupled to fixing wings 158 (refer to FIG. 5).

An indicator 250 is mounted to one side surface of the cover 200. The indicator 250 serves to indicate a position of the cartridge 150 to a user, and informs a mounted state of the cartridge 150 by being coupled to a movable frame to be later explained. This will be later explained in more detail.

A check valve 142 connected to a pump serving as a liquid spraying means is positioned below the cut-out portion 104, and a guide portion 140 having a cylindrical shape is disposed near the check valve 142. The guide portion 140 serve to insert and fix an outlet 166 (refer to FIG. 5) of the cartridge 150 therein.

FIG. 4 is an enlarged perspective view of the cover 200 of FIG. 1. Referring to FIG. 4, one side of the cover 200 is open, and another side thereof is provided with an inclination surface 202. An indicator installation portion 210 is extending to the left side of the inclination surface 202 in one direction, and is formed to have a concaved shape. A slot 212 for inserting the indicator 250 therein is formed in the indicator installation portion 210. A coupling portion 252 formed at a lower part of the indicator 250 is penetratingly inserted into the slot 212. The coupling portion 252 has a cylindrical shape extending to one side, and displays a moving state of the cartridge 150 while being moved together with a movable frame 300 to be later explained in a coupled state to the movable frame 300.

More concretely, a state that the indicator 250 has moved to the right side of the indicator installation portion 210 of FIG. 4 corresponds to a state that the outlet 166 of the cartridge 150 has been completely inserted into the guide portion 140. On the other hand, a state that the indicator 250 has moved to the left side of the indicator installation portion 210 corresponds to a state that the outlet 166 of the cartridge 150 has been separated from the guide portion 140. In this case, the separated cartridge 150 can be withdrawn to the outside. Through the indicator, 250, a user can check whether the cartridge 150 has been mounted to or separated from the guide portion 140.

A damping member 220 is installed at one side of the cover 200, and attenuates impacts and noise that may occur when the door 110 being open and closed collides with the cover 200.

Figure 5:
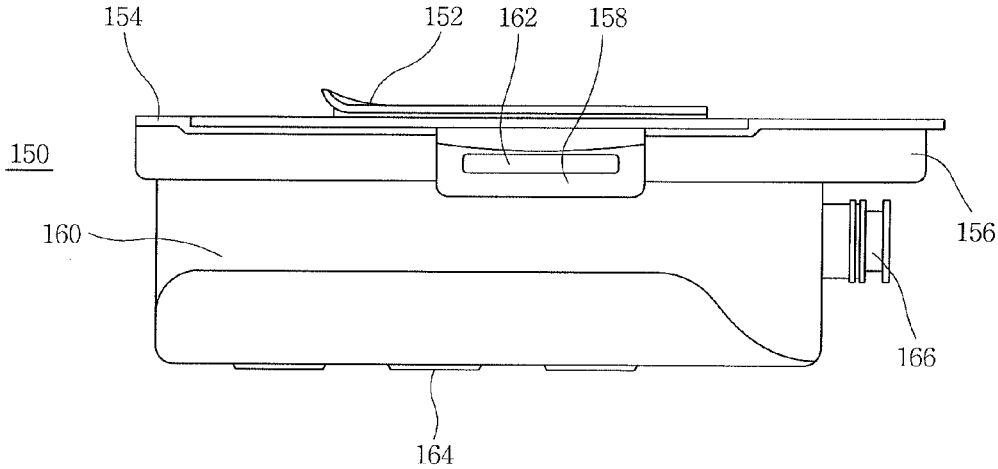
FIG. 5 is a side sectional view of a cartridge of FIG. 1.

FIG. 5 is a side sectional view of the cartridge 150 of FIG. 1. Three protrusions 164 are protruding from a bottom surface of the container 160. The protrusions are engaged with concaved portions formed on a bottom surface of the movable frame to be later explained, thereby guiding the cartridge 150 to be mounted to a precise position. As aforementioned, the outlet 166 is formed on one side surface of the cartridge 150. The outlet 166 is disposed so as to be adjacent to an upper side of the container 160. This may prevent liquid from flowing through the outlet 166 in a connection process of the check valve 142 to the outlet 166 when compared with a case that the outlet 166 is disposed so as to be adjacent to a bottom surface of the container 160.

The container 160 includes therein a discharge pipe 168 extending up to a bottom surface thereof so as to smoothly discharge liquid even in a case that a small amount of liquid remains therein. The discharge pipe 168 is extending between the outlet 166 and the bottom surface of the container 160. Referring to FIG. 5, the discharge pipe 168 is configured to have a bending portion, but the present invention is not limited to this. That is, the discharge pipe 168 may be extending in the form of a straight line between the outlet 166 and the bottom surface of the container 160.

A part of a side surface of the outlet 166 of the cartridge 150 is outwardly protruding more than a lower part of the container 160, which serves as a handgrip 156. More concretely, the handgrip 156 is disposed above the inclination surface 202 of the cover 200. Since the inclination surface 202 and the handgrip 156 are spacing from each other, a user can smoothly separate the cartridge 150 by putting his or her hand in the space formed between the inclination surface 202 and the handgrip 156.

A supplementary cap 152 is mounted to a middle part of the lid 154. The supplementary cap 152 serves to open and close an inlet (not shown) of the lid 154. In case of supplementing liquid into the cartridge 150, liquid is supplemented through the inlet by opening the supplementary cap 152. In case of cleaning the cartridge 150, a user can access inside the container 160 by opening the lid 154. The inlet is provided with a filter (not shown), thereby preventing foreign materials inside liquid to be supplemented from being introduced into the cartridge.

Figure 6:
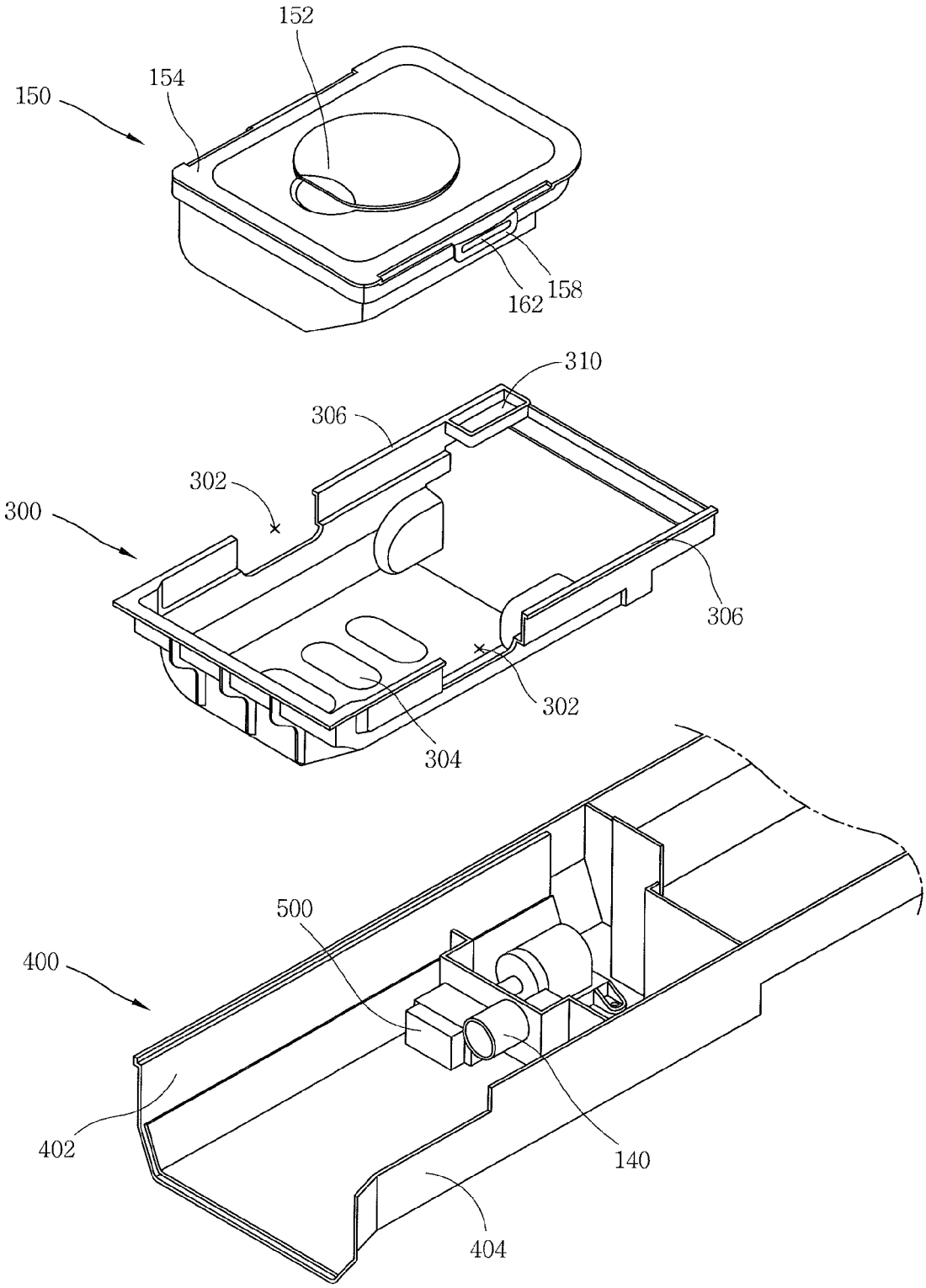
FIG. 6 is an exploded perspective view of a movable frame and a reservoir installation portion disposed below a cover of FIG. 1.

FIG. 6 is an exploded perspective view of a movable frame 300 and a reservoir installation portion 400 disposed below the cover 200 of FIG. 1. Referring to FIG. 6, the movable frame 300 has a rectangular parallelepiped shape of which upper side is open, so that the cartridge 150 can be inserted to be fixed therein. Once the cartridge 150 is inserted into the movable frame 300, side surfaces and a bottom surface of the movable frame 300 contact side surfaces and a bottom surface of the cartridge 150, respectively. This may allow the cartridge 150 to be stably supported without moving.

The aforementioned fixing wings 158 and the fixing protrusions 162 are positioned on side surfaces of the cartridge 150. For prevention of interference with the fixing wings 158 and the fixing protrusions 162, cut-out portions 302 are formed on both side walls of the movable frame 300. Three concaved portions 304 are formed on a bottom surface of the movable frame 300. The concaved portions 304 are engaged with the protrusions 164 formed on a bottom surface of the cartridge 150, thereby guiding the cartridge 150 to be disposed at a precise position inside the movable frame 300.

A guide flange 306 is outwardly protruding from an upper end of a side wall of the movable frame 300. The guide flange 306 guides sliding movement of the movable frame 300. A recess 310 for fitting the coupling portion 252 of the indicator 250 is formed at one side of an edge of the movable frame 300. If the movable frame 300 moves as the coupling portion 252 is inserted into the recess 310, the indicator 250 moves together with the movable frame 300.

The movable frame 300 is slidably mounted to inside of the reservoir installation portion 400 installed in the body. The reservoir installation portion 400 is implemented in the form of a channel of which upper side is open, and has a side wall 402 and a bottom surface 404. A flange supporting portion 406 on which the guide flange 306 of the movable frame 300 is disposed is formed on an upper part of the side wall 402.

A partition wall 440 is installed in the reservoir installation portion 400, and the guide portion 142 is formed at the partition wall 440. A pump 442 serving as a liquid spraying means is installed at a rear side of the partition wall 440. Additionally installed is a connection pipe (not shown) configured to connect the pump 442 and a check valve (not shown) installed in the guide portion 142.

A sensor installation portion 444 having a rectangular parallelepiped shape and having an open front surface is formed on a front surface of the partition wall 440, and a water level sensor 500 is installed in the sensor installation portion 444 to sense a remaining amount of liquid stored in the cartridge. The water level sensor 500 may be implemented as a capacitance type sensor for measuring changes of a dielectric constant according to the amount of liquid stored in the cartridge. This will be explained later in more detail.

The operation of the clothes treating apparatus will be explained with reference to FIG. 3.

In case of replacing the mounted cartridge with a new one or supplementing liquid, a user opens the door 110 and then slides the cartridge 150 toward a front surface of the body with grasping the handgrip. As a result, the movable frame 300 coupled to the cartridge 150 performs a sliding movement in the reservoir installation portion 400. This may cause the outlet 166 of the cartridge 150 to be separated from the guide portion 142. Then, the user can withdraw the cartridge 150 to the outside through the cut-out portion 104.

On the contrary, in case of mounting the cartridge 150 to the guide portion 140, it is checked whether the movable frame 300 is in a backwardly moved state through the indicator. If the movable frame 300 is not in a backwardly moved state, the movable frame 300 is backwardly moved and then the cartridge is mounted in the movable frame 300. Here, the concaved portions 304 and the protrusions 164 are engaged to one another so as to mount the cartridge to a precise position. Then, the cartridge 150 is pushed to a rear side of the body. As a result, the movable frame 300 is slid along the reservoir installation portion, and the outlet 166 is inserted into the guide portion 142, thereby completely mounting the cartridge 150 to the guide portion 140.

The present invention is not limited to the above preferred embodiment, but may be variously implemented within the scope of claims. For instance, the movable frame allows the cartridge to have a smooth sliding movement, and fixes the cartridge. Alternatively, the movable frame may be configured not to perform the above functions.

Figure 7:
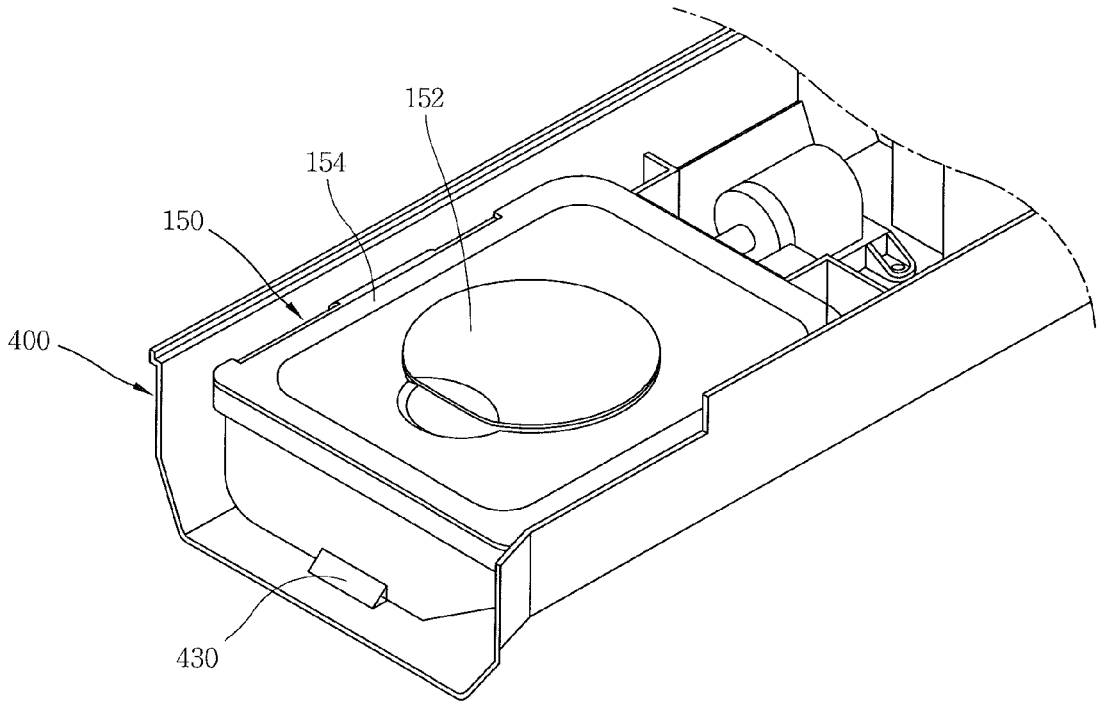
FIG. 7 is a perspective view of a reservoir installation portion having a cartridge mounted thereat of a clothes treating apparatus having a liquid reservoir according to another embodiment of the present invention.

More concretely, as shown in FIG. 7, the cartridge may be directly mounted to inside of the reservoir installation portion 400 without the movable frame 300. In this case, a side wall and a bottom surface of the cartridge 150 are arranged so as to contact a side wall and a bottom surface of the reservoir installation portion, thereby fixing the cartridge to the reservoir installation portion. The concaved portions formed on a bottom surface of the movable frame 300 are disposed on a bottom surface of the reservoir installation portion 400. Owing to the concaved portions and the protrusions, the cartridge may be fixed to a precise position. However, in order to more stably couple the cartridge to the reservoir installation portion, a stopper 430 is installed on a bottom surface of the reservoir installation portion. The stopper 430 is formed to have a triangular sectional surface, and is configured so that one side surface thereof can come in contact with a side surface of the cartridge when the cartridge is disposed at a precise position.

Figure 8:
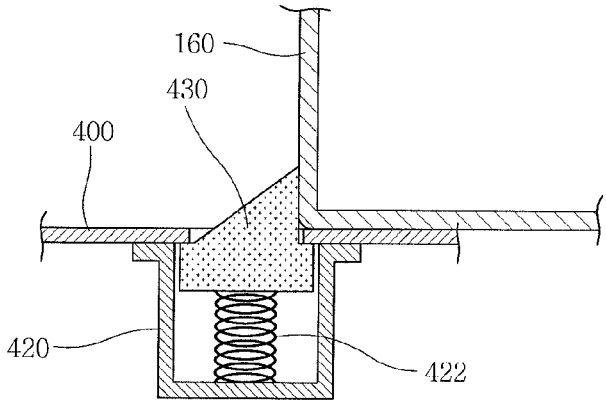
FIG. 8 is a sectional view of a stopper of FIG. 7.

FIG. 8 is a sectional view of the stopper of FIG. 7. The stopper 430 is mounted in a fixing bracket 420 installed below a bottom surface of the reservoir installation portion 400 so as to be slidable in upper and lower directions. A coil spring 422 is installed between the stopper 430 and a bottom surface of the fixing bracket 420, thereby applying an upward elastic force to the stopper 430.

In case of mounting the cartridge, the stopper 430 is pressed on a bottom surface of the cartridge thus to be pushed into the fixing bracket 420. However, if the cartridge is slid to be disposed at a precise position, the stopper 430 is upwardly protruded by an elastic force from the coil spring 422 thereby preventing the cartridge from being backwardly pushed.

In case of separating the cartridge, a user may press the stopper 430 with using his or her hand to put into the fixing bracket 420, and then separate the cartridge in a sliding manner.

Hereinafter, the water level sensor 500 will be explained with reference to FIGS. 9 to 11. Referring to FIG. 6, the water level sensor 500 is disposed at a rear side of the cartridge 150. Here, the water level sensor 500 may be disposed at a side surface of the cartridge 150. The water level sensor 500 includes an electrode plate 510 (refer to FIG. 11) disposed to face liquid stored in the cartridge, a printed circuit board (PCB) 520 (refer to FIG. 11) having the electrode plate attached thereto, and a housing 530 configured to accommodate the electrode plate 510 and the PCB 520 therein. A cable (c) is connected to a rear surface of the PCB 520 thus to be connected to a microcomputer. The housing has a nearly hexahedron shape of which one surface is open. Further provided is a cover 535 mounted to the open surface.

The electrode plate 510 is formed of a dielectric substance, and undergoes dielectric polarization and has changed capacitance when facing material to be detected at a near position. Since the capacitance is changed according to a type of material to be sensed, various types of material can be sensed. For instance, in an assumption that a dielectric constant of air is '1' and a dielectric constant of water is about '80', the air and the water can be distinguished from each other based on the difference between the dielectric constants. That is, if a type of material disposed near the electrode plate 510 is changed, the electrode plate 510 undergoes dielectric polarization and has a changed capacitance. When water is stored in the cartridge, the existence of the water may be detected by using the above principle of the electrode plate 510. Also, when fragrant liquid is stored in the cartridge, the existence of the fragrant liquid may be also detected by using the above principle of the electrode plate 510 since the fragrant liquid almost consists of water (more than about 90%).

The electrode plate 510 is formed of a conductor. Preferably, the electrode plate 510 is implemented as a thin film formed of gold or silver or copper, and is mounted to an inner front surface of the housing 530 so that a wide surface of the thin film can face a rear surface of the cartridge. That is, the electrode plate 510 faces liquid stored in the cartridge in a state that the front surface of the housing 530 and the rear surface of the cartridge are disposed therebetween. Under these configurations, a high level state that the cartridge is filled with liquid can be distinguished from a low level state that liquid having a smaller amount than a preset amount is stored in the cartridge. An area and an installation position in a height direction of the electrode plate may be suitably controlled. More concretely, if the electrode plate 510 is installed at a suitable position in a height direction and an area of the electrode plate 510 facing the cartridge is properly preset, the electrode plate 510 may detect a specific level such as a high level and a low level of water stored in the cartridge, and may detect a water level as a quantitized value if necessary.

The water level sensor 500 further includes a sensing unit configured to sense changes of capacitance according to dielectric polarization of the electrode plate 510, and to transmit a signal to a microcomputer (not shown). The sensing unit is connected to the electrode plate and the microcomputer by cables, and detects changes of capacitance of the electrode plate by using an oscillation circuit. Then, the sensing unit converts the detected changes into a switching signal to transmit to the microcomputer. The microcomputer determines a level of fragrant liquid stored in the cartridge based on the received signal. The sensing unit may be disposed at any position. However, the sensing unit is preferably disposed at the PCB 520 arranged in the housing 530 of the water level sensor. That is, it is preferable that the electrode plate 510 is attached to the PCB 520 and the PCB 520 is fixed to inside of the housing. However, the present invention is not limited to this, and the sensing unit may be additionally disposed outside the housing 530.

Figure 9:
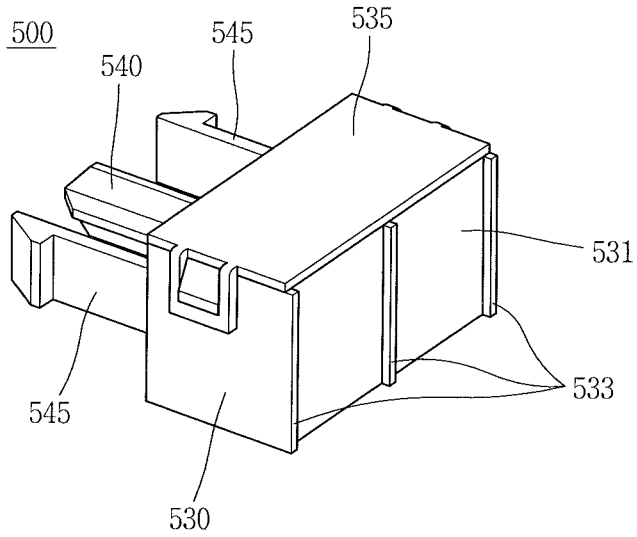
FIG. 9 is an enlarged perspective view of a water level sensor of FIG. 6.
Figure 10:
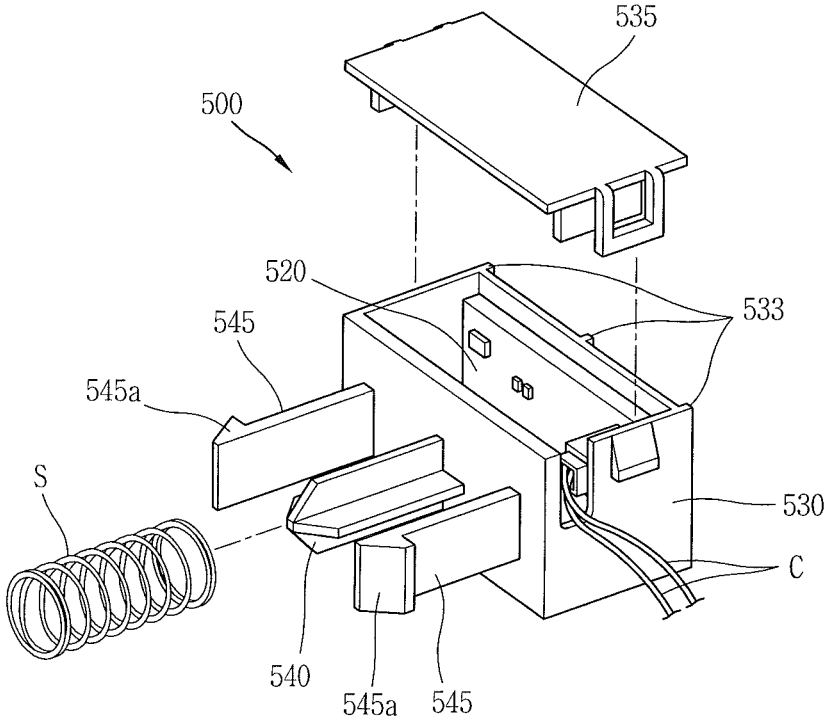
FIG. 10 is an exploded perspective view of the water level sensor of FIG. 9.
Figure 11:
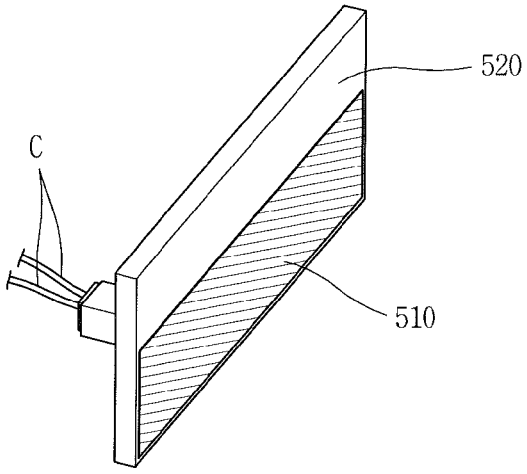
FIG. 11 is a perspective view showing a part of the water level sensor of FIG. 9.

As shown in FIGS. 9 to 11, a spring mounting portion 540 is backwardly protruding from a central portion of a rear surface of the housing 530. And, a coupling portion 545 having a hook 545*a* at the end thereof is backwardly protruding from the rear surface of the housing. The water level sensor is mounted to an upper surface of the body, more concretely, a water level sensor mounting portion disposed at a rear side of the cartridge. The water level sensor mounting portion is provided with a hook inserting hole (not shown) for inserting therein the hook 545*a* of the coupling portion 545 of the housing, and is provided with a protrusion inserting hole (not shown) for inserting therein the spring mounting portion 540 of the housing. The water level sensor is coupled to the body as the coupling portion 545 of the housing is fixedly-coupled the sensor installation portion 444 by hooks.

The water level sensor is coupled to an upper portion of the body in a state that a coil spring (s) has been mounted to the spring mounting portion 540. Once the water level sensor is coupled to an upper portion of the body, the coil spring (s) is in a compressed state between a rear surface of the housing of the water level sensor and an upper surface of the clothes treating apparatus. Since the coil spring (s) is in a compressed state, the spring forwardly presses the rear surface of the housing. This may allow the water level sensor 500 to always receive force in a forward direction, that is, a direction toward a rear surface of the cartridge. As a result, a front surface of the water level sensor can maintain an adhered state to a rear surface of the cartridge. The coil spring (s) presses the housing 530 of the water level sensor mounted to an upper surface of the body from a rear side, thereby adhering the housing 530 to the cartridge. This may allow the water level sensor to more precisely detect a level of liquid stored in the cartridge.

Protrusions 533 are formed on a front surface of the housing facing the cartridge. The protrusions 533 may have various shapes such as a semi-spherical shape. In the preferred embodiment, the protrusions 533 are extending from the front surface of the housing in a long shape in upper and lower directions. Owing to the protrusions disposed on the front surface of the housing, the front surface of the housing and the rear surface of the cartridge adhered to each other are prevented from plane-contacting each other. This may prevent water from remaining on a part between the front surface of the housing and the rear surface of the cartridge plane-contacting each other. If water remains on the front surface of the housing, the water level sensor can not precisely detect a level of liquid stored in the cartridge.

Figure 12:
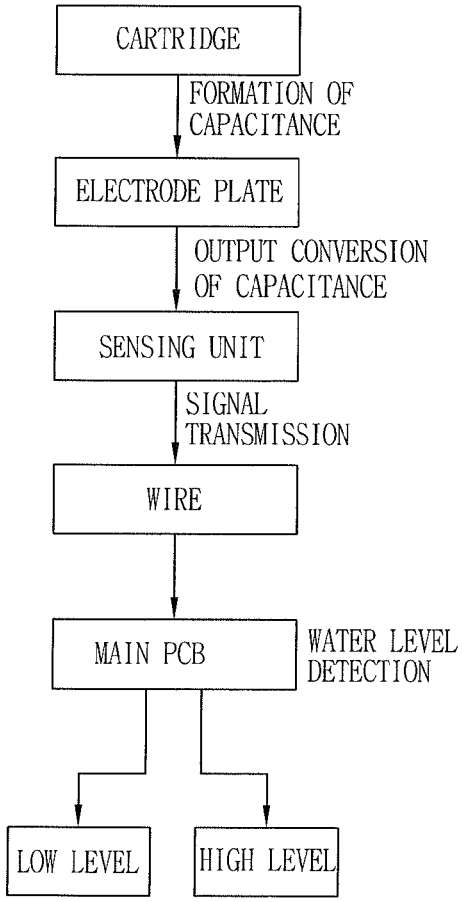
FIG. 12 is a flowchart showing processes for detecting a water level by using the water level sensor of FIG. 9.

FIG. 12 is a flowchart showing processes for detecting a water level by using the water level sensor of FIG. 9.

If a level of liquid stored in the cartridge is changed, the electrode plate has changed capacitance according to dielectric polarization. And, the sensing unit detects changed capacitance of the electrode plate between the electrode plate and the microcomputer, and transmits a signal to the microcomputer. Then, the microcomputer determines a level of the liquid stored in the cartridge. If it is determined that the fragrant liquid has a level lower than a preset reference value, the microcomputer displays the low level state on a display unit disposed on a front surface of the body. This may allow a user to recognize a level of the liquid stored in the cartridge. The display unit is generally positioned at a control panel disposed on the front surface of the clothes treating apparatus, thereby displaying each operation state of the clothes treating apparatus.

In the above configurations, it was explained that one electrode plate of the water level sensor was installed in the housing. However, the present invention is not limited to this, but the electrode plate may be provided in plurality in number. That is, one or more electrode plates may be installed at the PCB with different heights. And, the PCB may detect changes of capacitance of each of the electrode plates to transmit a signal to the microcomputer. Then, the microcomputer more precisely determines a level of the liquid based on the information, and then displays the determined level on the display unit disposed on a front surface of the body. Here, the level of the liquid may be displayed in various manners. For instance, the level of the liquid may be displayed in the form of 'HIGH', 'MIDDLE' and 'LOW'. Alternatively, the level of the liquid may be displayed by turning on a light switch corresponding to a current level among a plurality of light switches vertically arranged in one line.

In the present invention, the capacitance type water level sensor is adopted to detect a level of liquid without directly contacting the liquid. This may prevent mal-sensing since scales are not accumulated on a part to be sensed, and may implement excellent durability.

Figure 13:
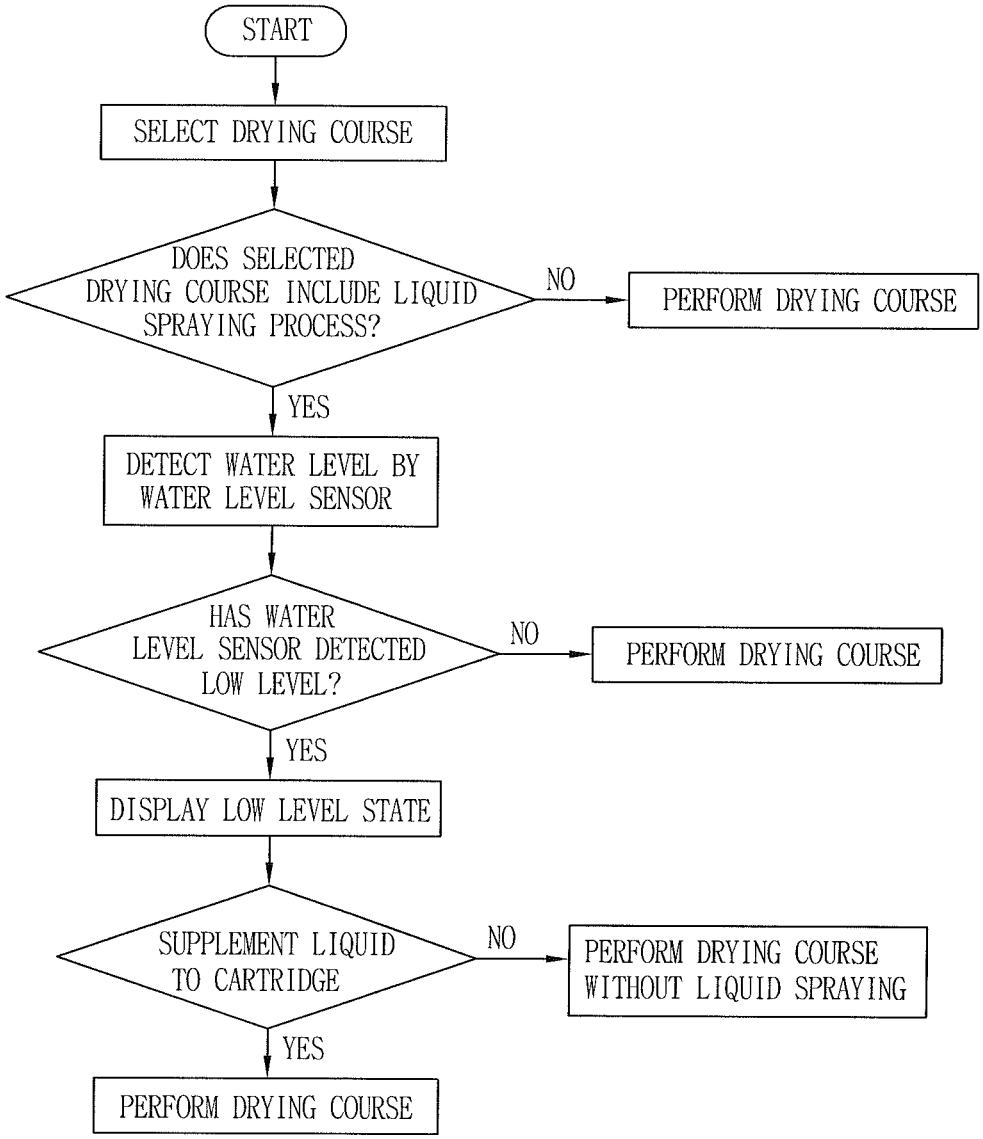
FIG. 13 is a flowchart showing processes for spraying liquid to clothes and drying the clothes by using the water level sensor.
Figure 14:
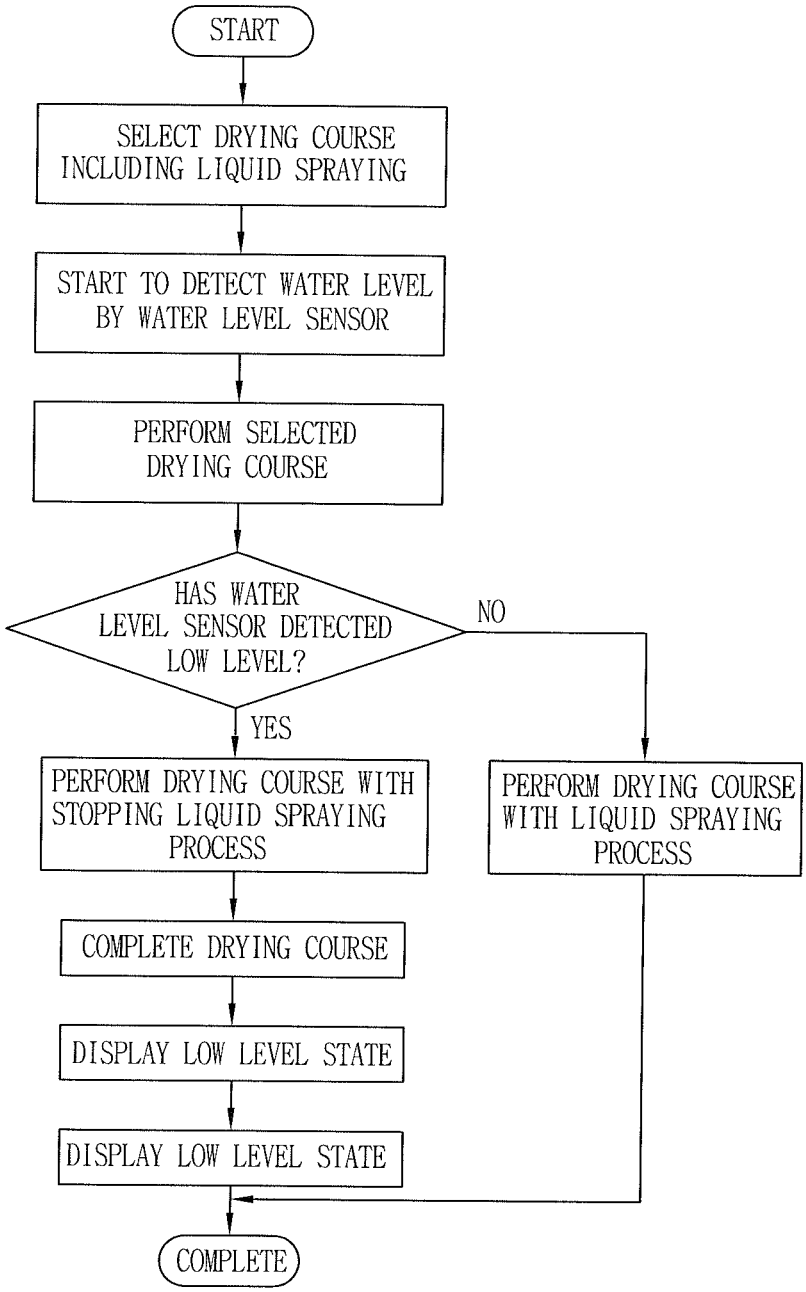
FIG. 14 is a flowchart showing other processes for spraying liquid to clothes and drying the clothes by using the water level sensor.

With reference to FIGS. 13 and 14, will be explained a method for drying clothes by spraying liquid to the clothes in the clothes treating apparatus having the capacitance type water level sensor.

Firstly, a user applies power to the clothes treating apparatus by manipulating the control panel disposed at an upper part of a front surface of the clothes treating apparatus, selects a button corresponding to a specific drying course, and starts an operation by pressing a 'start' button of the selected drying course. Then, a controller of the clothes treating apparatus performs an operation of the selected drying course among preset various algorithms. That is, the clothes treating apparatus is operated by inputting a power button, a selection button, and a start button, sequentially.

If a drying course including fragrant material spraying is selected from a plurality of drying courses, i.e., if a selection button of a drying course including fragrant material spraying is inputted, the water level sensor starts to detect a level of fragrant liquid stored in the cartridge. In case of performing a drying course not including a fragrant material spraying process, a level of the fragrant liquid needs not be detected. If a drying course including fragrant material spraying is selected, the water level sensor starts to detect a level of the liquid stored in the cartridge. Here, the water level sensor detects the level of the liquid with a constant period until the drying course is completed.

If a selection button of a drying course including fragrant material spraying is inputted, the water level sensor starts to detect a level of the fragrant liquid stored in the cartridge. If it is determined that the fragrant liquid has a low level, the low level state is displayed on the display unit disposed on a front surface of the clothes treating apparatus. That is, the low level state is informed to a user in a state that a selection button of a drying course has been inputted, but a start button has not been inputted.

Here, the user may select a drying method.

Firstly, the user may supplement fragrant liquid to the cartridge so as to solve the low level state, and then presses a start button of the selected drying course, thereby performing a desired drying course including fragrant material spraying. In this case, since the low level state has been solved, the low level state is not displayed on the display unit.

Secondly, the user may ignore the low level state, and press a start button of the selected drying course, thereby performing a drying course without fragrant material spraying. This method is effective when the user does not wish to perform a drying process with supplementing fragrant liquid after recognizing the low level state, or when there is no fragrant liquid to be supplemented. If a start button of the selected drying course is pressed without supplementing fragrant liquid, the drying course is performed with maintaining the low level state. The low level state is released if fragrant liquid is supplemented even during a drying course. The low level state may be displayed in various manners. For instance, a display lamp may be visually turned on or off on the display unit of the control panel. Alternatively, beeper sound may ring in addition to the display lamp at the time of an initial low level state. Still alternatively, characters of 'ADD fragrant liquid' may be displayed on the display unit in a flicking manner.

Hereinafter, will be explained a case that fragrant liquid is sufficient during an initial drying course, but the fragrant liquid is deficient during a fragrant material spraying process. Once a drying course including fragrant material spraying is selected, the selected drying course is performed while the water level sensor detects a level of the liquid. In the preferred embodiment, if a low level is detected while performing the drying course, the fragrant material spraying process is stopped. The fragrant material spraying process is performed as the fragrant liquid stored in the liquid reservoir is pressed by a pump and then is sprayed through a nozzle which is toward inside of the drum. Therefore, to stop the fragrant material spraying process means to stop a pumping operation by the pump. If the pumping operation is continuously performed in a state that no fragrant liquid exists, severe noise may occur and the pump may have a shortened lifespan.

If a low level is detected during the drying course, the fragrant material spraying process is stopped but the selected drying course is continuously performed. Here, the selected drying course is continuously performed without displaying the low level state to the outside. That is, if a low level is detected while performing a drying course including fragrant material spraying, the pumping operation is stopped, and a selected drying course is continuously performed to be completed without displaying the low level state to the outside. If the drying course is completed, the low level state is displayed to the outside. Methods for displaying the low level state to the outside are similar to the aforementioned methods, and thus their detailed explanations will be omitted.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes treating apparatus with a liquid reservoir, the apparatus comprising:

a body having a drum accessible from a front therein;

a liquid spraying means configured to spray liquid into the drum;

a reservoir installation portion disposed at an inner upper portion of the body and accessible from above the body;

a liquid reservoir detachably fixed to inside of the reservoir installation portion, and having an outlet on a side surface thereof;

a coupling means configured to fix the liquid reservoir to the reservoir installation portion; and a cover disposed above the coupling means, wherein a cut-out portion communicated with the reservoir installation portion and through which the liquid reservoir passes is formed on an upper surface of the body and accessible from above the body, wherein the liquid reservoir is introduced into the reservoir installation portion through the cut-out portion, and then is coupled to the liquid spraying means by sliding movement, and where a display means which moves together with the coupling means is disposed at the cover.

2. The apparatus of claim 1, wherein the reservoir installation portion includes two side walls facing each other, and a bottom surface which connects lower portions of the side walls with each other, wherein the reservoir installation portion is formed so as to be extending in back and forth directions of the body.

3. The apparatus of claim 2, wherein a connection portion connected to the outlet of the liquid spraying means is installed at the reservoir installation portion.

4. The apparatus of claim 3, wherein the connection portion includes:

a guide portion formed at an inner side of the connection portion with a cylindrical shape and configured to insert the outlet thereinto; and a check valve installed in the guide portion.

5. The apparatus of claim 1, further comprising a guide means configured to guide the liquid reservoir so as to be installed at a precise position.

6. The apparatus of claim 5, wherein the guide means includes:

a protrusion formed on a bottom surface of the liquid reservoir; and a concaved portion formed on a bottom surface of the reservoir installation portion and engaged with the protrusion.

7. The apparatus of claim 1, wherein the liquid reservoir is mounted to inside of the coupling means, and the coupling means is slidably installed in the reservoir installation portion.

8. The apparatus of claim 1, wherein the display means includes:

an indicator disposed at an upper side of the cover; and a coupling portion disposed at a lower side of the cover and coupled to the coupling means.

9. The apparatus of claim 1, wherein the display means includes an indicator extending from the coupling means and upwardly protruding by penetrating through the cover.

10. A clothes treating apparatus with a liquid reservoir, the apparatus comprising:

a body having a drum accessible from a front therein;

a liquid spraying means configured to spray liquid into the drum;

a reservoir installation portion disposed at an inner upper portion of the body and accessible from above the body;

a liquid reservoir detachably mounted to inside of the reservoir installation portion by being slid in the reservoir installation portion, and having an outlet on a side surface thereof; a water level sensor installed in the reservoir installation portion, and configured to detect a level of liquid stored in the liquid reservoir by using changes of capacitance;

a coupling means configured to fix the liquid reservoir to the reservoir installation portion; and a cover disposed above the coupling means, wherein a cut-out portion communicated with the reservoir installation portion and through which the liquid reservoir passes is formed on an upper surface of the body and accessible from above the body, wherein the liquid reservoir is coupled to the liquid spraying means by sliding movement of the coupling means, and wherein a display means which moves together with the coupling means is disposed at the cover.

11. The apparatus of claim 10, wherein the water level sensor includes:

an electrode plate having dielectric polarization according to whether it approaches to liquid inside the liquid reservoir, and a housing configured to accommodate the electrode plate therein.

12. The apparatus of claim 11, wherein the housing is installed at a rear side of the liquid reservoir such that a front surface of the housing faces a rear surface of the liquid reservoir.

13. The apparatus of claim 12, wherein a protrusion is formed on the front surface of the housing facing the liquid reservoir, thereby preventing remaining of moisture.

14. The apparatus of claim 12, wherein the housing includes:

a spring mounting portion backwardly protruding from a central portion of a rear surface of the housing;

a spring inserted into an outer circumference of the spring mounting portion; and a coupling portion backwardly protruding from a rear surface of the housing and having a hook at an end thereof.

15. The apparatus of claim 10, wherein the water level sensor further includes a sensing unit configured to sense changes of capacitance according to dielectric polarization of the electrode plate, and to transmit a signal to a microcomputer.

16. The apparatus of claim 15, wherein when it is determined that fragrant the liquid has a low level based on a received signal, the microcomputer displays the low level state on a display unit provided on a front surface of the body.

17. A clothes treating apparatus with a liquid reservoir, the apparatus comprising:

a body having a drum accessible from a front therein;

a liquid spraying means configured to spray liquid into the drum;

a reservoir installation portion disposed at an inner upper portion of the body and accessible from above the body;

a coupling means slidably installed in the reservoir installation portion; a liquid reservoir detachably fixed into the coupling means, and having an outlet on a side surface thereof; and a cover disposed above the coupling means, wherein a cut-out portion communicated with the reservoir installation portion and through which the liquid reservoir passes is formed on an upper surface of the body and accessible from above the body, wherein the liquid reservoir is coupled to the liquid spraying means by sliding movement of the coupling means, and wherein a display means which moves together with the coupling means is disposed at the cover.

18. The apparatus of claim 7, wherein the display means includes:

an indicator disposed at an upper side of the cover; and a coupling portion disposed at a lower side of the cover and coupled to the coupling means.

19. The apparatus of claim 17, wherein the display means includes an indicator extending from the coupling means and upwardly protruding by penetrating through the cover.

* * * * *